United States Patent [19]

Pugliese

[11] Patent Number: 4,678,060

[45] Date of Patent: Jul. 7, 1987

[54] COLLAPSIBLE LADDER DEVICE

[76] Inventor: Joseph A. Pugliese, 94 Elm Ave., Fairview, N.J. 07022

[21] Appl. No.: 899,637

[22] Filed: Aug. 25, 1986

[51] Int. Cl.[4] ..... E06C 1/383

[52] U.S. Cl. ..... 182/160; 182/96; 182/212

[58] Field of Search ..... 182/159, 160, 161, 96, 182/156, 212

[56] References Cited

U.S. PATENT DOCUMENTS

| | | | |
|---|---|---|---|
| 314,899 | 3/1885 | Wilson . | |
| 350,047 | 9/1886 | Dunn | 182/96 |
| 364,546 | 6/1887 | Roed . | |
| 785,810 | 3/1905 | Koopman | 182/160 |
| 1,140,281 | 5/1915 | Otto | 182/160 |
| 1,232,221 | 7/1917 | Chesebro | 182/160 |
| 2,492,511 | 12/1949 | Yehling | 182/160 |
| 2,727,671 | 3/1953 | Ollerhead . | |
| 2,962,113 | 11/1960 | Heimlicher | 182/160 |
| 3,414,081 | 12/1968 | Wedvik | 182/160 |
| 3,439,776 | 4/1968 | Scheerer . | |
| 3,480,106 | 11/1969 | Weiner | 182/96 |
| 3,517,770 | 6/1970 | Loix | 182/160 |
| 4,463,829 | 8/1984 | Grin | 182/96 |

*Primary Examiner*—Reinaldo P. Machado

*Attorney, Agent, or Firm*—Stewart L. Gitler; Martin P. Hoffman; Mitchell B. Wasson

[57] ABSTRACT

This invention relates to a ladder device, particularly to one that is collapsible. More particularly, provided is a ladder that can be opened or closed from the ground or some elevated point. Additionally, there is provided a feature so that the ladder can be completely closed. The ladder comprises a remote-control system that permits all of the above-identified attributes to be accomplished.

7 Claims, 8 Drawing Figures

COLLAPSIBLE LADDER DEVICE

BACKGROUND OF THE INVENTION

The present invention relates to a ladder device, particularly to one that is collapsible.

The prior art is familiar with various ladders that can be considered to be collapsible. Some of these prior art ladders have rungs that are pivotably connected to the side rails of the ladder at one or both rung ends, with the pivot points being located at the centers of their end parts. Because of this feature, the rungs are not in a vertical position when the ladder is closed, or collapsed, as a result of which the ladder might not be completely closed, i.e., the side rails may be spaced apart by a distance, and, thus, possibly allowing the unauthorized use of or tampering with the ladder.

OBJECT OF THE INVENTION

An object of the present invention is to provide an improved closeable or collapsible ladder.

Another object is to provide such a ladder of improved design.

Another object is to provide such a ladder that can be opened or closed from the ground or some elevated point.

Another object is to provide such a ladder that can be completely closed.

BRIEF SUMMARY OF THE INVENTION

The present invention comprises a collapsible ladder device that includes first and second railing members that are disposed opposite each other in substantially parallel relationship with each other. There are a plurality of rung elements disposed between the railing members in spaced apart relationship, these rung elements having respective first ends disposed adjacent to the first railing member and respective second ends disposed adjacent to the second railing member.

A first set of bracket members is disposed at respective ones of the rung element first ends and a second set of bracket members is disposed at respective ones of the rung element second ends. These bracket members of the first set are pivotably connected to the first railing members and the bracket members of the second set are pivotably connected to said second railing member, with pin means for connecting the bracket members to their respective railing members. The pivot pin means are removed from the central axes, or centers, of their respective bracket members, whereby the bracket members can act to limit the travel of the railing members when the ladder device is opened for use and to permit the ladder to be closed completely. The bracket members can have rounded shoulder portions to permit clearance, and one pivot pin of a bracket for a certain rung can be above the bracket center while the rung's second bracket pivot pin is below the bracket center, with the pins located at the outside side of the brackets' centers.

The ladder comprises a remote-control system that permits its being opened or closed from an elevated point or the ground.

PREFERRED EMBODIMENT

Figure 1:
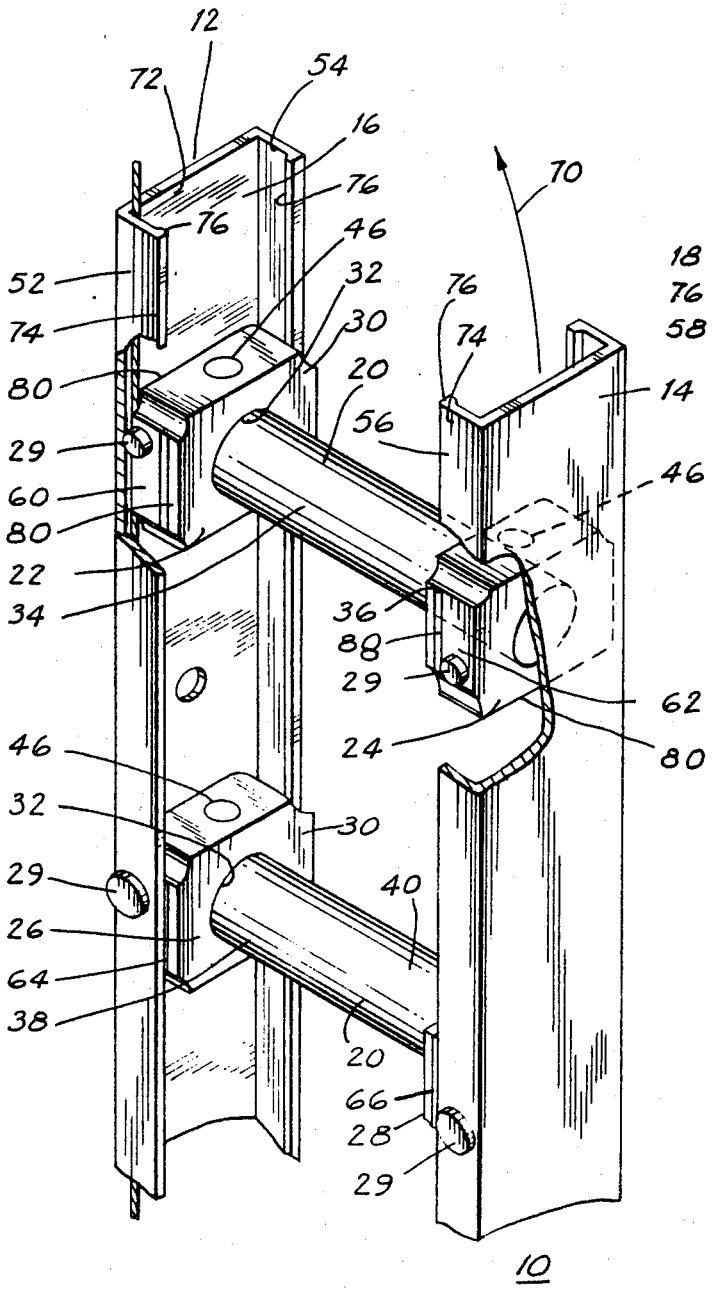
FIG. 1 is a fragmentary, partially cut away, perspective view of a preferred embodiment of a collapsible ladder device according to the present invention.

With reference to FIG. 1, the present invention comprises a collapsible ladder device 10 that can be used as a ladder alone, as part of a fire escape system, or otherwise. The ladder device 10 comprises first and second railing members 12,14 that are disposed opposite each other and are substantially parallel to each other. It is preferred that the railing members 12,14 have respective channels 16,18 that extend along their lengths, the railing members 12,14 being disposed such that their respective channels 16,18 face each other.

The ladder device 10 further comprises plural rungs 20 that are spacedly disposed along all or part of the length of the side railing members 12,14. These rungs 20 are connected to the side railing members 12,14 by means of bracket structures 22–28 that are associated with respective side railing members 12,14.

The bracket members 22–28 can be box-shaped or of some other shape and are connected to the railing members 12,14 by means of pins 29, as described in greater detail below.

Each of the bracket members 22–28 comprises a face 30 that faces, when the ladder 10 is open, the railing member 12 or 14 other than the one it is associated with, and there is a hole or recess 32 located at this face 30, that receives an end 34,36,38,40 of a respective rung 20, the rung ends 34–40 being fixedly disposed in their respective holes or recesses 32. A pin 46 can be used to hold each rung in place with respect to its bracket.

The bracket members 22–28 are pivotably connected to their respective railing members 12,14 by the pin elements 29 that can extend between the channel side walls 52,54 and 56,58 and completely through their respective bracket members 22–28 or can extend through the channel side walls 52–58 and only partially into their respective bracket members 22–28.

According to a preferred embodiment, the pin elements 29 are located off-center at the side faces 60,62,64,66 of their respective bracket members 22–28. It is especially preferred that the pin elements 29 of one set of bracket members, e.g. 22,26, disposed at one of the railing members 12,14, be located generally above and laterally to the center of the side faces 60,64, and that the pin elements 29 of the other set of bracket members 24,28 be located generally below and laterally to the center of the side faces 62,66.

Preferably, the bracket members 22–28 are nested in the channels 54,53 of their respective railing members 12,14 and have a height dimension that is about the same as or more than the depth of their associated channel 54,58. The bracket height preferably is less than twice the channel depth to allow it to be nested between the side rails when the ladder is closed.

The ladder device 10 of the present invention can be opened and closed, or collapsed, by moving the side rail members 12,14 away from or toward each other (the arrow 70 showing the direction of movement to close the ladder), thus causing the bracket members 22–28 and the rungs 20 extending between the bracket members 22–28 and side rail members, to pivot or swing. The rungs 20 can be swung from a substantially vertical position (where the ladder is closed) to a substantially horizontal position (where the ladder is open).

Figure 3:
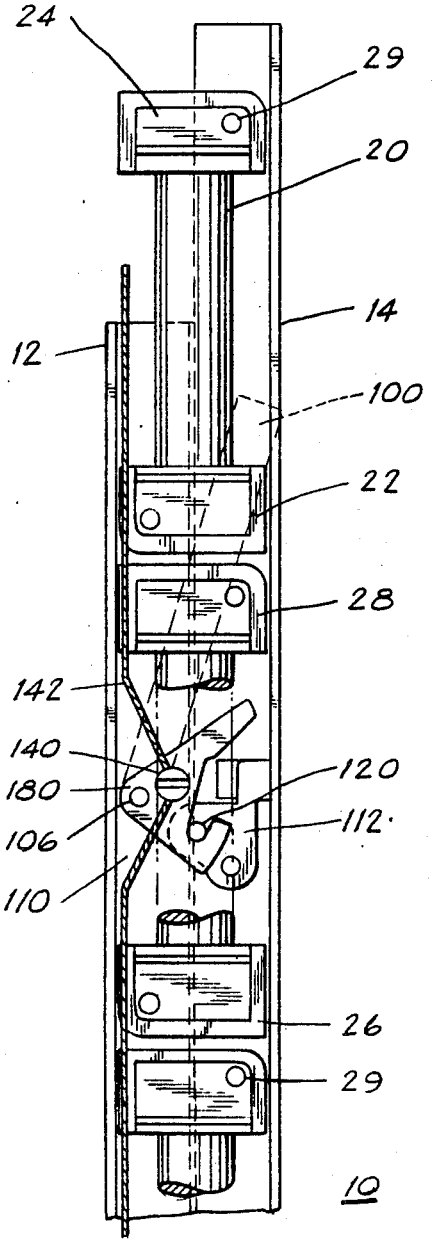
FIG. 3 is a partial sectional side elevation view of the ladder device according to a further preferred embodiment, comprising a remote-control mechanism for opening and closing the ladder device.

Because the pin elements are located off-center, the bracket members 22–28 can be rotated between a first position (ladder closed), as in FIG. 3, to a second position (ladder open) as in FIG. 1, the bracket members 22–28, when in their second positions, engaging the bottom wall 72 of their respective channels 16,18 thus limiting the rotational motion of the bracket members 22–28 and preventing the rungs 20 from swinging past their horizontal positions. This provides greater stability to the ladder.

According to a further preferred embodiment, the ladder 10 of the present invention comprises at on or both of the distal edges 74 of each railing member 12,14, a protruberance or ridge 76 that extends partly into the channel 16,18 of its respective railing member 12,14. Each of the bracket members 22–28 also includes a detent or slot 88 at one or both of its side faces 62–64, which detent 88 can receive and be engaged by the ridges 76 so as to serve to increase the rigidity of the ladder when opened. To accomplish this, the span between oppositely disposed ridges 76 should be somewhat less than the distance between the side faces of the various bracket members 22–28, such that the bracket members 22–28 can be snapped into place between their respective ridges 76.

It is also preferred that the bracket member 22–28 comprise rounded shoulders 80 at their corners proximate the pivot pins 29 so as to facilitate clearance between the bracket members 22–28.

Figure 2:
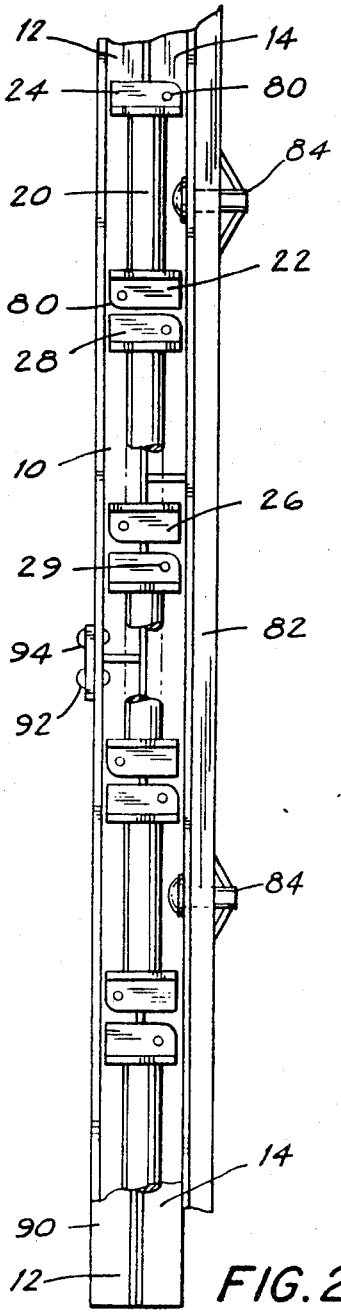
FIG. 2 is a fragmentary, sectional side elevation view of a preferred embodiment of the ladder device of FIG. 1, in closed position and mounted on a wall for use as a fire escape or otherwise.

In the embodiment shown in FIG. 2 (where numerals used in other figures identify similar parts), the ladder device 10 of the present invention is utilized as a fire escape. Here the ladder device 10 is attached to a wall 82 by anchor bolts 84 or other suitable means, the ladder 10 being closed and, thus, not usable by anyone other than those persons in the building. By thus preventing the use of the ladder 10 by unauthorized persons, burglars or other unauthorized persons are denied access to the building.

The ladder 10 (FIG. 2) is closed and, because of the particular structure of the present invention, the bracket members 22–28 and the rungs 20 are substantially completely encased between the side rail members 14,16 and are not accessible or viewable, thus providing an aesthetically attractive structure.

Where several separate ladder segments 10,90 are utilized together, they may be connected by, e.g., a plate 92 that is connected to the side rails 12 of the respective ladders 12,14 by bolts 94 or other means.

Figure 4:
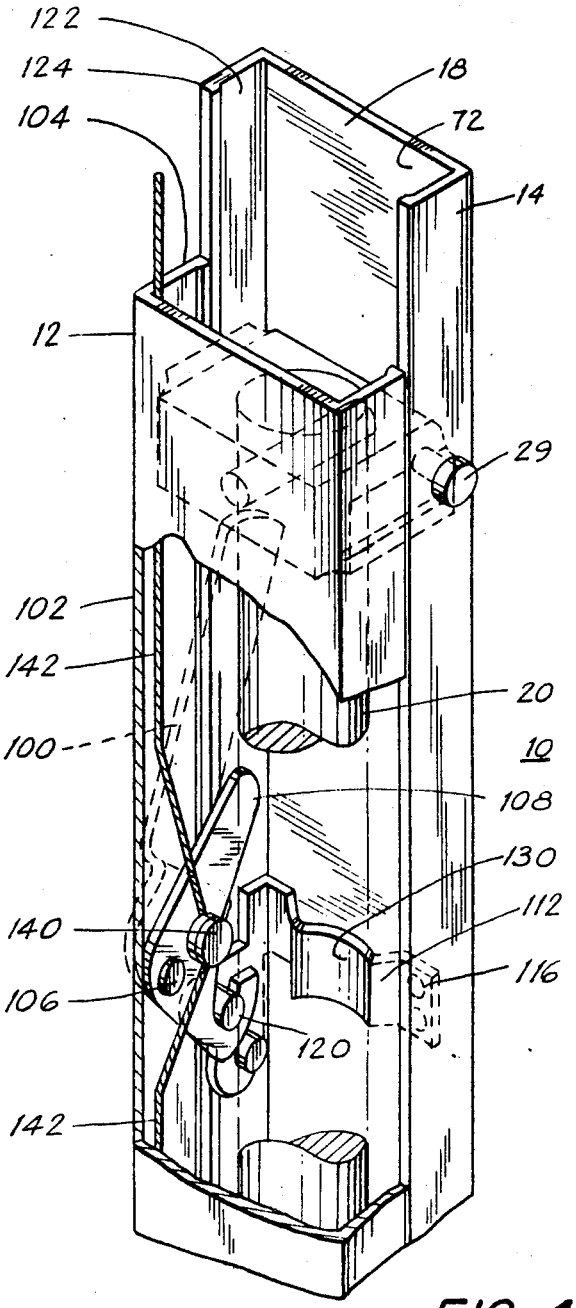
FIG. 4 is a partial fragmentary view, in perspective, of the ladder device of FIG. 3.

Various means may be used to retain the ladder device of the present invention, in its closed position. One such means comprises a locking arrangement having a lever arm 100 that is disposed at one outer face 102 of a side wall 104 of a side rail member 12 (FIGS. 3 and 4) and is connected, via a rod or pin member 106 passing through the side wall 104 to a lock clamp 108 that is located at the opposite inner face 110 of the side wall 104. The lock 108 can be generally hook-shaped or otherwise and forms a unitary structure with the rod member 106 and the lever arm 100. The rod member 106 is rotatable in the hole (not shown ) in the side wall 104 at which it is located, so that the lever arm 100 an the lock clamp 108 can be moved in an arcuate path.

At the channel 18 of the other side rail member 14 there is a bracket 112 that is fixed to the side rail member 14 by means of rivets 116 or other suitable means. The bracket 112 comprises a post element 120 that is located at the inner face 122 of the side wall 124 of the side rail member 14, which post element 120 protrudes out from the side wall 124 and partly into the channel 18. The post element 120 is disposed so as to receive and be engaged by the lock clamp 108, whereby these parts can hold the two side rail members 12,14 together in a ladder-closed situation.

Where it is desired, the bracket 112 can comprise a U-shaped portion 130 at the bottom wall 72 of the side rail member 14, so that a rung 20 of the ladder 10 can, when the ladder is closed, be received by the U-shaped portion 130 and be retained in position. It is possible for the U-shaped portion 130 to be made of springy material (e.g. steel, etc.) so that the rung 20 bears against it, the springiness of the U-shaped portion 130 urging the rung 20 away, so as to maintain a slight load on the hook-like lock clamp 108 - post element 120, whereby they remain firmly engaged and the ladder is better held in its closed condition.

Figure 5:
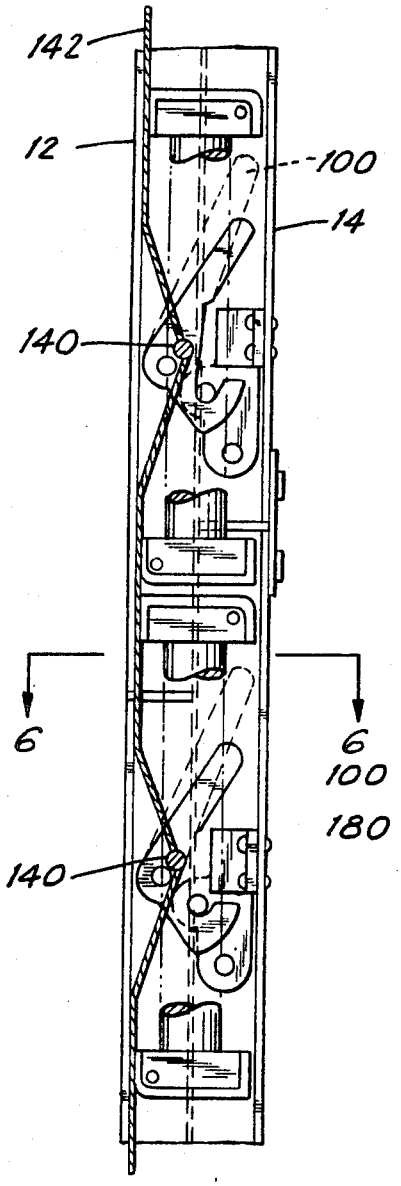
FIG. 5 is a partial side elevation view of the ladder device of FIG. 3 in closed position mounted in tandem with another such ladder device.
Figure 6:
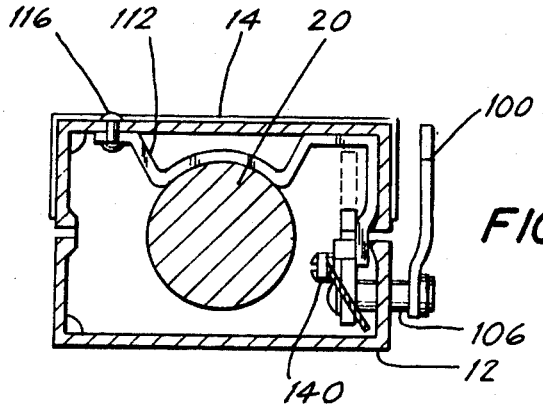
FIG. 6 is a sectional plan view, along line 6—6 of the device in FIG. 5.
Figure 7:
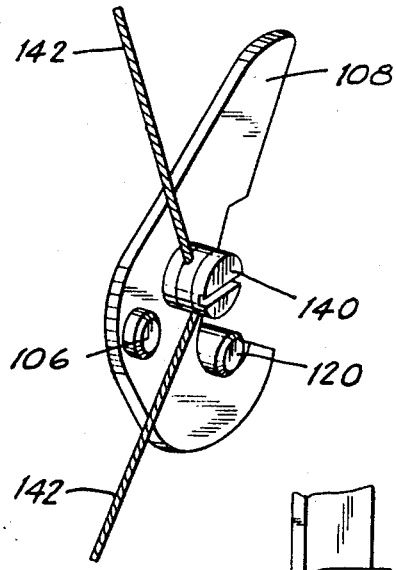
FIG. 7 is a partial perspective view of the lock plate of the ladder in FIG. 3.
Figure 8:
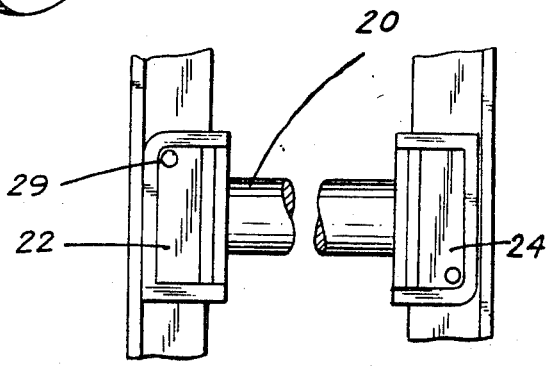
FIG. 8 is a broken side elevation view of the rung and bracket structure of the present invention.

A preferred embodiment of the ladder device 10 comprises means for remotely controlling the locking arrangement so as to disengage the lock clamp 108 from the post element 120. This is especially desirable where the ladder device is used for a fire escape system. In this embodiment the lock clamp 108 comprises a lug 140 that protrudes inward and one or more connecting rods (or wires, etc.) 142 that are connected to the lug 140 and extend in opposite directions along the ladder 10. Hence, where a person who wishes to use the ladder 10, is in a building but is removed from the release lever arm 100, he may pull (or push) the connecting rod 142, which, in turn, rotates the lug 140 and causes the lock clamp 108 to rotate and to be disengaged from the lock post element 100.

Where several ladders are used together in tandem (FIG. 5), several such locking arrangements may be utilized, with one for each ladder 10.

The ridge 76 of the side railing member can be formed in the production of the side railing, so as to be an integral part of it (e.g., by swaging, upsetting, or otherwise), or it can be a separate part that is attached to the side railing.

I claim:

1. A collapsible ladder device, comprising:

(a) first and second railing members disposed opposite each other in substantially parallel relationship with each other;

(b) a plurality of rung elements disposed between said railing members in spaced apart relationship, said rung elements having respective first ends disposed adjacent to said first railing member and respective second ends disposed adjacent to said second railing member;

(c) a first set of bracket members disposed at respective ones of said rung element first ends and a second set of bracket members disposed at respective ones of said rung element second ends, said bracket members of said first set being pivotably connected to said first railing member and said bracket members of said second set being pivotably connected to said second railing member; and (d) pin means for connecting said bracket members to their respective railing members, said pin means being disposed so as to be removed from the central axes of their respective bracket members, whereby said bracket members can act to limit the travel of said railing members when said ladder device is opened for use wherein said side railing members comprise protruberances disposed at their distal edge regions and said bracket members comprise respective detents at their side faces, whereby said protruberances can engage said bracket members at their respective detents when said ladder is open, thereby serving to provide greater rigidity to said ladder device.

2. A collapsible ladder device as in claim 1, wherein said first and second railing members comprise respective channels extending along the length thereof, said channels facing each other and said bracket members being nested within respective said channels.

3. A collapsible ladder device as in claim 1, wherein a first one of said pin means associated with a certain rung element is disposed above the center of the side face of its associated bracket member and a second one of said pin means associated with said certain rung element is disposed below the center of the side face of its associated bracket member.

4. A collapsible ladder device as in claim 3, wherein said pin means are disposed between the center of said side face and the respective outer edges of said bracket means.

5. A collapsible ladder device as in claim 1, wherein said side rail members comprise channels extending therealong and said bracket members individual height dimensions that are at most substantially equal to twice the depth of a side rail member channel so that said bracket members can be nested between said side rail members when said ladder is in a closed condition.

6. A collapsible ladder device as in claim 5, wherein said height dimensions are less than twice the said channel depth.

7. A collapsible ladder device as in claim 1, further comprising means for operating said ladder device from a remote point.

* * * * *